US009111483B2

(12) United States Patent
Miyake et al.

(10) Patent No.: US 9,111,483 B2
(45) **Date of Patent: *Aug. 18, 2015**

(54) DISPLAY DEVICE

(71) Applicant: Semiconductor Energy Laboratory Co., Ltd., Atsugi-shi, Kanagawa-ken (JP)

(72) Inventors: Hiroyuki Miyake, Kanagawa (JP); Kouhei Toyotaka, Kanagawa (JP); Kazunori Watanabe, Kanagawa (JP); Toru Tanabe, Kanagawa (JP); Makoto Kaneyasu, Kanagawa (JP); Masashi Fujita, Tokyo (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 290 days.

This patent is subject to a terminal disclaimer.

(21) Appl. No.: 13/718,402

(22) Filed: Dec. 18, 2012

(65) Prior Publication Data

US 2013/0162609 A1 Jun. 27, 2013

(30) Foreign Application Priority Data

Dec. 23, 2011 (JP) ..... 2011-282439

(51) Int. Cl.
*G09G 3/20* (2006.01)

(52) U.S. Cl.
CPC ..... *G09G 3/20* (2013.01); *G09G 2370/08* (2013.01)

(58) Field of Classification Search
CPC ..... G09G 3/20; G09G 5/00; G09G 2370/08
USPC ..... 345/204
See application file for complete search history.

(56) References Cited

U.S. PATENT DOCUMENTS

| | | | | |
|---|---|---|---|---|
| 6,388,652 | B1 | 5/2002 | Yamazaki et al. | |
| 6,778,164 | B2 | 8/2004 | Yamazaki et al. | |
| 6,956,324 | B2 | 10/2005 | Yamazaki | |
| 7,256,776 | B2 | 8/2007 | Yamazaki et al. | |
| 7,750,899 | B2 | 7/2010 | Miyata et al. | |
| 7,830,370 | B2 | 11/2010 | Yamazaki et al. | |
| 7,978,190 | B2 | 7/2011 | Yamazaki et al. | |
| 8,878,706 | B2 * | 11/2014 | Fujita | 341/101 |
| 2013/0201165 | A1 * | 8/2013 | Fujita | 345/204 |

FOREIGN PATENT DOCUMENTS

| | | | |
|---|---|---|---|
| JP | 2011-237644 | A | 11/2011 |
| JP | 2011-238067 | A | 11/2011 |

* cited by examiner

*Primary Examiner* — Allison Johnson
*Assistant Examiner* — Afroza Chowdhury
(74) *Attorney, Agent, or Firm* — Fish & Richardson P.C.

(57) ABSTRACT

To provide a display device with high image quality and fewer terminals. The present invention is made with a focus on the positional relation between a serial-parallel conversion circuit and an external connection terminal for supplying a serial signal to the serial-parallel conversion circuit. The structure conceived is such that a serial-parallel conversion circuit and an external connection terminal for supplying a serial signal to the serial-parallel conversion circuit are provided close to each other so that an RC load between the serial-parallel conversion circuit and the external connection terminal is reduced.

19 Claims, 4 Drawing Sheets

DISPLAY DEVICE

BACKGROUND OF THE INVENTION

1. Field of the Invention

The present invention relates to a display device.

2. Description of the Related Art

In order to display an image on a display device, a large number of image signals need to be supplied to the display device. Further, a large number of wirings are needed to connect a device for supplying image signals (e.g., a main body of an electronic device) to the display device. For example, about 640 wirings are needed for VGA. Accordingly, the wirings occupy volume in part of the display device, which might limit the flexibility in design such as the size of the electronic device and the position of the display device.

In view of such a background, it is desired that the number of external connection terminals in a display device be reduced. For example, Patent Document 1 discloses a method in which a serial-parallel conversion circuit is provided in a display device and an image signal is supplied as a serial signal from a main body of an electronic device through a serial cable.

REFERENCE

Patent Document

[Patent Document 1]

Japanese Published Patent Application No. 2011-237644

SUMMARY OF THE INVENTION

However, because of having high frequency, a serial signal for transmitting an image signal including a large amount of image data is sensitive to delay.

One embodiment of the present invention is made in view of the foregoing technical background. One object is to provide a display device with high image quality and fewer terminals.

In order to achieve the above object, one embodiment of the present invention is made with a focus on the positional relation between a serial-parallel conversion circuit and an external connection terminal for supplying a serial signal to the serial-parallel conversion circuit. This leads to a display device having a structure exemplified in this specification. In a display device of one embodiment of the present invention, a serial-parallel conversion circuit and an external connection terminal for supplying a serial signal to the serial-parallel conversion circuit are provided close to each other so that an RC load between the serial-parallel conversion circuit and the external connection terminal is reduced.

One embodiment of the present invention is a display device including a pixel region having a plurality of pixels arranged in a matrix, a scanning line driver circuit electrically connected to the pixel region, a signal line driver circuit electrically connected to the pixel region, a serial-parallel conversion circuit configured to supply a parallel signal to the signal line driver circuit, and a first external connection terminal configured to supply a serial signal to the serial-parallel conversion circuit. In the display device, the serial-parallel conversion circuit includes a transistor having a crystalline silicon film formed over an element substrate provided with the pixel region. When an RC load between the first external connection terminal and the serial-parallel conversion circuit is represented by RC, RC satisfies a formula (1) below.

$$RC < \frac{1}{3 \cdot H \cdot V \cdot fps \cdot ln(2n)} \quad (1)$$

In the formula (1), H represents the number of pixels provided for one scanning line (also called the number of pixels in the horizontal direction), V represents the number of scanning lines (also called the number of pixels in the vertical direction), fps represents a frame rate, and n represents the number of grayscales.

In the display device of one embodiment of the present invention, the serial-parallel conversion circuit and the external connection terminal configured to supply a serial signal to the serial-parallel conversion circuit are provided close to each other so that the RC load between the serial-parallel conversion circuit and the external connection terminal is reduced. Accordingly, a serial signal having high frequency can be stably received. As a result, a display device with high image quality and fewer terminals can be provided.

One embodiment of the present invention is the aforementioned display device in which the signal line driver circuit is provided along a row of the pixel region, and the scanning line driver circuit is provided along a column of the pixel region. In the display device, the serial-parallel conversion circuit is provided in a corner portion where the signal line driver circuit and the scanning line driver circuit are close to each other, and the serial-parallel conversion circuit is provided more apart from the pixel region than the scanning line driver circuit is. In addition, a wiring is provided between the pixel region and the signal line driver circuit so as to extend along the row of the pixel region. Through the wiring, a parallel signal is supplied from the serial-parallel conversion circuit to the signal line driver circuit.

In the display device of one embodiment of the present invention, the serial-parallel conversion circuit is provided close to the signal line driver circuit. Further, the wiring, through which the parallel signal is supplied from the serial-parallel conversion circuit to the signal line driver circuit, is provided along the row of the pixel region. Accordingly, a wiring for connecting the serial-parallel conversion circuit to the signal line driver circuit can be shortened as compared to other arrangement, whereby delay can be made less likely to occur. As a result, a display device with high image quality and fewer terminals can be provided.

One embodiment of the present invention is the aforementioned display device further including a timing signal generation circuit, a second external connection terminal configured to supply a clock signal to the timing signal generation circuit, and a third external connection terminal configured to supply a start pulse signal to the timing signal generation circuit. In the display device, the timing signal generation circuit includes a transistor having a crystalline silicon film formed over the element substrate. In addition, the timing signal generation circuit outputs timing signals to the signal line driver circuit, the scanning line driver circuit, and the serial-parallel conversion circuit.

The display device of one embodiment of the present invention is provided with the timing signal generation circuit which can generate two or more timing signals from the clock signal supplied through the second external connection terminal. Accordingly, the display device can be driven using two or more timing signals without an external connection terminal for a timing signal. As a result, the display device with high image quality and fewer terminals can be provided.

One embodiment of the present invention is the aforementioned display device further including a timing signal generation circuit, a second external connection terminal configured to supply a clock signal to the timing signal generation circuit, and a third external connection terminal configured to supply a start pulse signal to the timing signal generation circuit. In the display device, the signal line driver circuit is provided along a row of the pixel region, and the scanning line driver circuit is provided along a column of the pixel region. In the display device, the serial-parallel conversion circuit is provided in a corner portion where the signal line driver circuit and the scanning line driver circuit are close to each other, and the serial-parallel conversion circuit is provided more apart from the pixel region than the scanning line driver circuit is. In the display device, the timing signal generation circuit is provided in a position close to the second external connection terminal, and the timing signal generation circuit is provided adjacent to the serial-parallel conversion circuit and apart from the pixel region. In the display device, the timing signal generation circuit includes a transistor having a crystalline silicon film formed over the element substrate, and the timing signal generation circuit outputs timing signals to the signal line driver circuit, the scanning line driver circuit, and the serial-parallel conversion circuit.

In the display device of one embodiment of the present invention, the timing signal generation circuit is provided in a position close to the second external connection terminal configured to supply a clock signal. Further, the timing signal generation circuit is provided adjacent to the serial-parallel conversion circuit and apart from the pixel region. Accordingly, a wiring for connecting the timing signal generation circuit to the second external connection terminal can be shortened as compared to other arrangement, whereby delay can be made less likely to occur. As a result, a display device with high image quality and fewer terminals can be provided.

One embodiment of the present invention is the aforementioned display device further including a light-emitting element in each of the plurality of pixels. The light-emitting element includes a first electrode over the element substrate, a layer containing a light-emitting organic compound over the first electrode, and a second electrode over the layer containing a light-emitting organic compound. The second electrode is connected to a wiring over the element substrate through an opening portion which is provided to surround the pixel region.

The display device of one embodiment of the present invention includes the light-emitting element having the second electrode connected to the wiring through the opening portion which is provided to surround the pixel region. Accordingly, voltage drop due to sheet resistance of the second electrode can be suppressed in the entire pixel region, whereby display unevenness can be reduced. As a result, a self-luminous display device with high image quality and fewer terminals can be provided.

One embodiment of the present invention is the aforementioned display device further including a timing signal generation circuit, a second external connection terminal configured to supply a clock signal to the timing signal generation circuit, a third external connection terminal configured to supply a start pulse signal to the timing signal generation circuit, a fourth external connection terminal to which a high power supply potential is supplied, a fifth external connection terminal to which a low power supply potential is supplied, and a sixth external connection terminal to which a ground potential is supplied. In the display device, the signal line driver circuit is provided along a row of the pixel region, and the scanning line driver circuit is provided along a column of the pixel region. In the display device, the serial-parallel conversion circuit is provided in a corner portion where the signal line driver circuit and the scanning line driver circuit are close to each other, and the serial-parallel conversion circuit is provided more apart from the pixel region than the scanning line driver circuit is. In the display device, the timing signal generation circuit is provided in a position close to the second external connection terminal, and the timing signal generation circuit is provided adjacent to the serial-parallel conversion circuit and apart from the pixel region. In the display device, the timing signal generation circuit includes a transistor having a crystalline silicon film formed over the element substrate provided with the pixel region, and the timing signal generation circuit outputs timing signals to the signal line driver circuit, the scanning line driver circuit, and the serial-parallel conversion circuit. In the display device, the pixels provided in the pixel region each include a light-emitting element including a first electrode over the element substrate, a layer containing a light-emitting organic compound over the first electrode, and a second electrode over the layer containing a light-emitting organic compound. In the light-emitting element, the first electrode is supplied with a potential between the high power supply potential and the low power supply potential in accordance with the serial signal, and the second electrode is supplied with one of the high power supply potential and the low power supply potential.

The display device of one embodiment of the present invention includes the first external connection terminal configured to supply a serial signal to the serial-parallel conversion circuit, the second external connection terminal configured to supply a clock signal to the timing signal generation circuit, the third external connection terminal configured to supply a start pulse signal to the timing signal generation circuit, the fourth external connection terminal to which a high power supply potential is supplied, the fifth external connection terminal to which a low power supply potential is supplied, and the sixth external connection terminal to which a ground potential is supplied. As a result, a self-luminous display device with high image quality and fewer terminals can be provided.

One embodiment of the present invention is an electronic device including the above-described display device.

The display device of one embodiment of the present invention includes a self-luminous display device with high image quality and fewer terminals. Accordingly, the flexibility in design such as the size of an electronic device and the position of the display device provided in the electronic device can be increased. Thus, an electronic device which is reduced in size and weight and has excellent portability can be provided.

Note that an EL layer in this specification refers to a layer provided between a pair of electrodes in a light-emitting element. Thus, a light-emitting layer containing an organic compound that is a light-emitting substance which is interposed between electrodes is one embodiment of the EL layer.

In this specification, in the case where a substance A is dispersed in a matrix formed using a substance B, the substance B forming the matrix is referred to as a host material, and the substance A dispersed in the matrix is referred to as a guest material. Note that the substance A and the substance B may each be a single substance or a mixture of two or more kinds of substances.

Note that a light-emitting device in this specification means an image display device, a light-emitting device, or a light source (including a lighting device). In addition, the light-emitting device includes any of the following modules in its category: a module in which a connector such as an FPC (flexible printed circuit) or a TCP (tape carrier package) is attached to a light-emitting device; a module having a TCP provided with a printed wiring board at the end thereof; and a module having an IC (integrated circuit) directly mounted over a substrate over which a light-emitting element is formed by a COG (chip on glass) method.

In accordance with one embodiment of the present invention, a display device with high image quality and fewer terminals can be provided.

DETAILED DESCRIPTION OF THE INVENTION

Figure 1A:
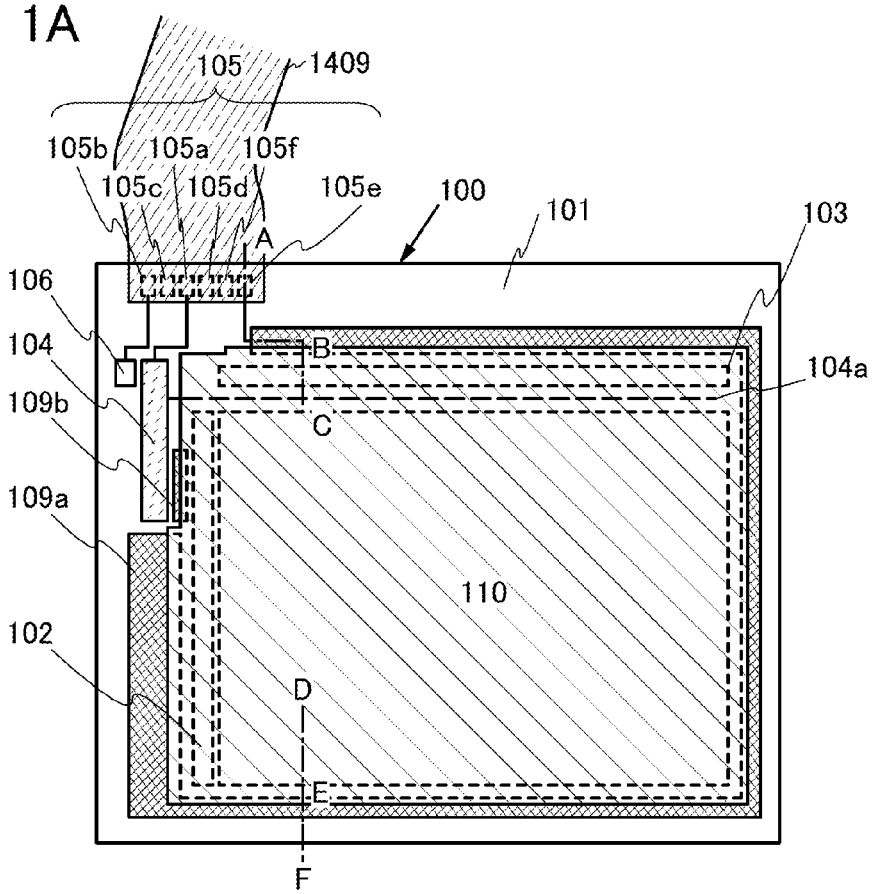
FIGS. 1A and 1B illustrate the structure of a display device according to an embodiment.

Embodiments will be described in detail with reference to the drawings. Note that the invention is not limited to the following description, and it will be easily understood by those skilled in the art that various changes and modifications can be made without departing from the spirit and scope of the invention. Therefore, the invention should not be construed as being limited to the description in the following embodiments. Note that in the structures of the invention described below, the same portions or portions having similar functions are denoted by the same reference numerals in different drawings, and description of such portions is not repeated.

Embodiment 1

In this embodiment, the structure of a display device of one embodiment of the present invention will be described with reference to FIGS. 1A and 1B. The display device exemplified in this embodiment includes a pixel region in which a plurality of pixels are arranged in a matrix, a scanning line driver circuit connected to the pixel region, a signal line driver circuit connected to the pixel region, a serial-parallel conversion circuit for supplying a parallel signal to the signal line driver circuit, and a first external connection terminal for supplying a serial signal to the serial-parallel conversion circuit. The serial-parallel conversion circuit includes a transistor having a crystalline silicon film formed over an element substrate provided with the pixel region. When an RC load between the first external connection terminal and the serial-parallel conversion circuit is represented by RC, RC satisfies the formula (1).

In the display device exemplified in this embodiment, the serial-parallel conversion circuit and the external connection terminal for supplying a serial signal to the serial-parallel conversion circuit are provided close to each other so that the RC load between the serial-parallel conversion circuit and the external connection terminal is reduced. Accordingly, a serial signal having high frequency can be stably received. As a result, a display device with high image quality and fewer terminals can be provided.

The structure of the display device exemplified in this embodiment will be described with reference to FIGS. 1A and 1B, FIGS. 2A and 2B, and FIG. 3.

Figure 1B:
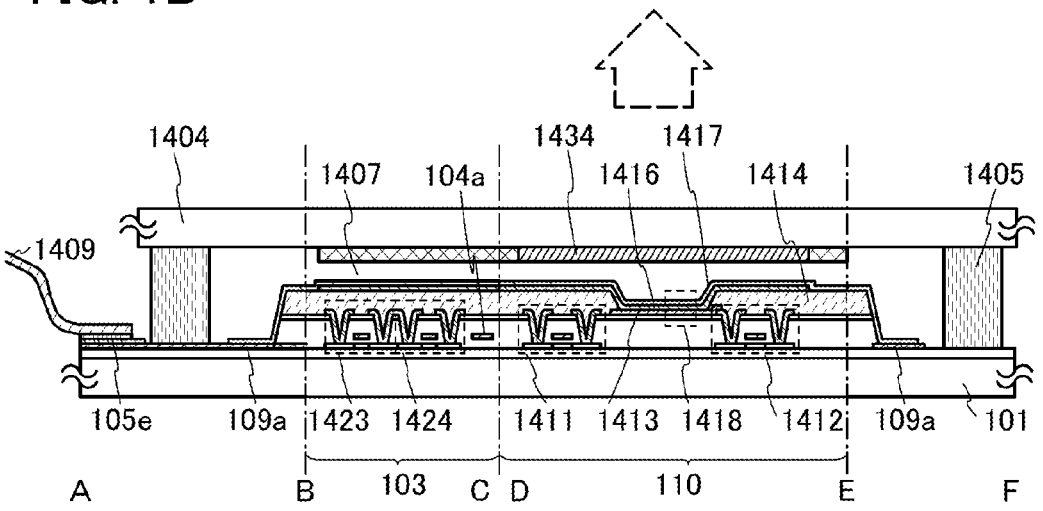

FIG. 1A is a top view showing the arrangement of elements included in the display device of one embodiment of the present invention, and FIG. 1B is a cross-sectional view taken along line A-B-C and line D-E-F in FIG. 1A.

Figure 2A:
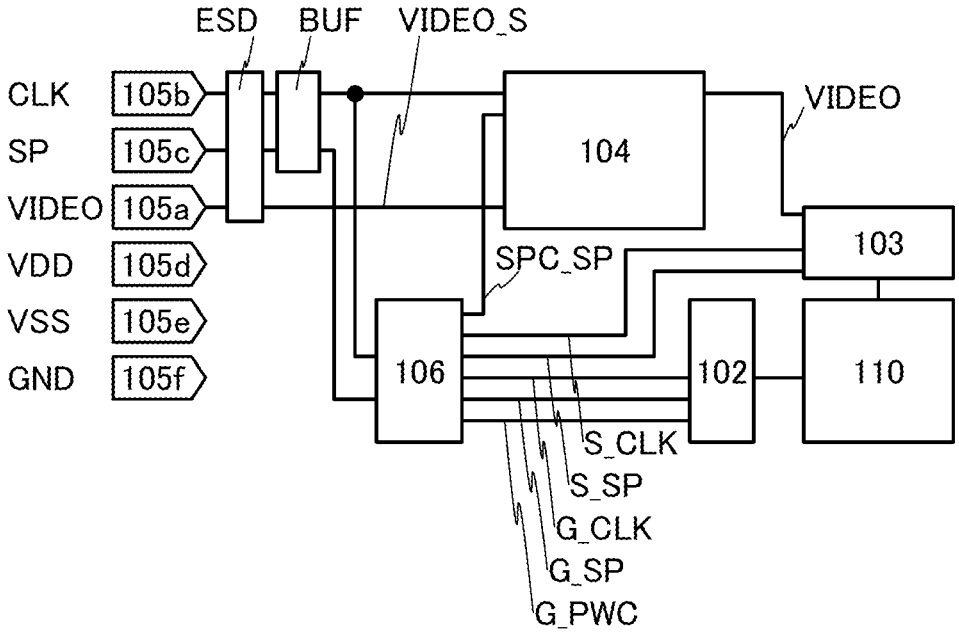
FIGS. 2A and 2B are block diagrams illustrating the structure of a display device according to an embodiment.
Figure 2B:
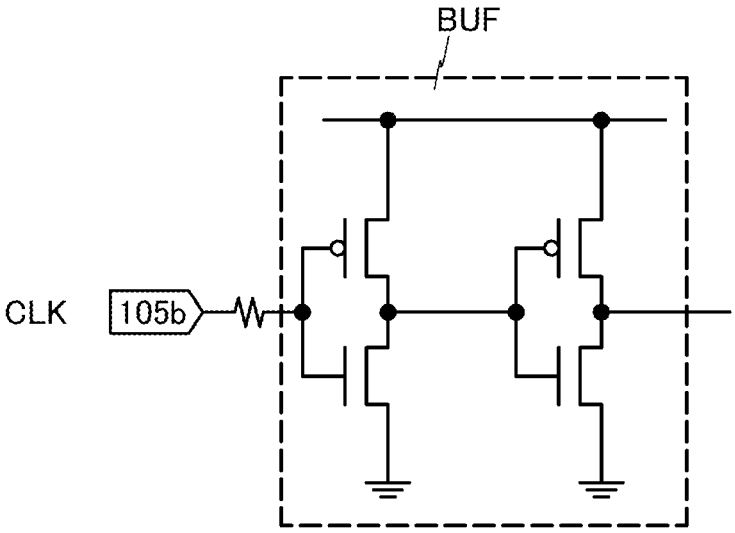

FIGS. 2A and 2B are block diagrams showing connection relations of elements included in the display device of one embodiment of the present invention.

Figure 3:
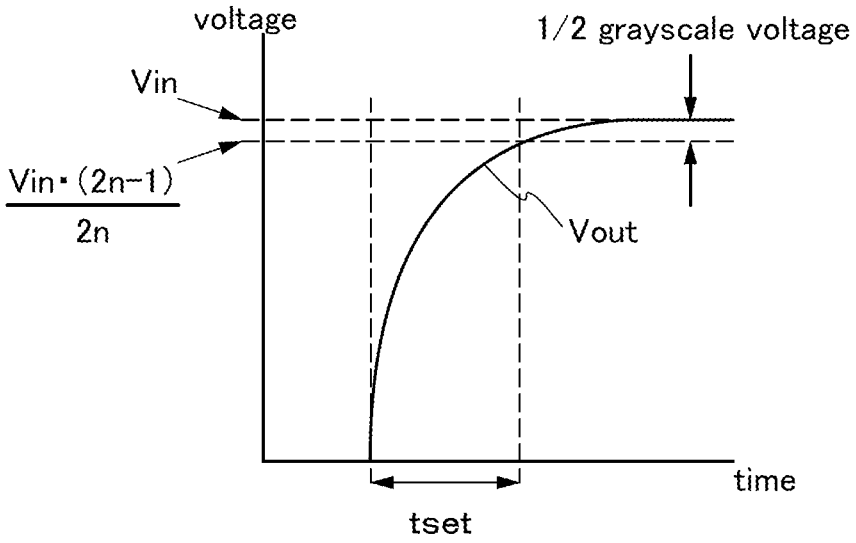
FIG. 3 is a conceptual diagram illustrating settling time according to an embodiment.

FIG. 3 is a conceptual diagram illustrating the behavior in which a serial signal, which has an amplitude Vin and is input to the external connection terminal, is input to a serial-parallel conversion circuit 104 with delay owing to an RC load RC between the external connection terminal and the serial-parallel conversion circuit.

A display device 100 exemplified in FIG. 1A includes a pixel region 110 in which a plurality of pixels are arranged in a matrix, a scanning line driver circuit 102 connected to the pixel region 110, a signal line driver circuit 103 connected to the pixel region 110, the serial-parallel conversion circuit 104 for supplying a parallel signal to the signal line driver circuit 103, and a first external connection terminal 105*a* for supplying a serial signal to the serial-parallel conversion circuit 104. The serial-parallel conversion circuit 104 includes a transistor having a crystalline silicon film formed over an element substrate 101 provided with the pixel region. When an RC load between the first external connection terminal 105*a* and the serial-parallel conversion circuit 104 is represented by RC, RC satisfies the formula (1).

The display device 100 includes an external connection terminal group 105. The external connection terminal group 105 includes the first external connection terminal 105*a*, a second external connection terminal 105*b*, a third external connection terminal 105*c*, a fourth external connection terminal 105*d*, a fifth external connection terminal 105*e*, and a sixth external connection terminal 105*f*. Note that the external connection terminal group 105 is electrically connected to an external connection line 1409.

The display device 100 further includes a timing signal generation circuit 106, a common connection portion 109*a*, and a common connection portion 109*b*.

Note that in FIG. 1A, part of the structure shown in FIG. 1B is omitted for convenience of description. Specifically, a counter substrate 1404 provided with a color filter 1434 and a sealing material 1405 are omitted.

FIG. 1B shows the structure of the cross section of the display device 100. In the pixel region 110, the cross section of one pixel is shown. One pixel includes a transistor 1411, a transistor 1412, and a light-emitting element 1418. The light-emitting element 1418 includes a first electrode 1413, a second electrode 1417, and a layer 1416 containing a light-emitting organic compound between the first electrode and the second electrode.

One of the first electrode 1413 and the second electrode 1417 transmits light emitted from the layer 1416 containing a light-emitting organic compound. In the light-emitting element 1418 exemplified in this embodiment, the second electrode 1417 has a light-transmitting property, so that light is extracted from the second electrode 1417 side.

The first electrode 1413, the edge portion of which is covered with a partition wall 1414, is electrically connected to a source electrode or a drain electrode of the transistor 1412. The second electrode 1417, which is extended to the outside of the pixel region 110, is electrically connected to a common wiring through the common connection portion 109*a*. Note that the common wiring is electrically connected to the fifth external connection terminal 105*e*.

The signal line driver circuit 103 includes a transistor 1423 and a transistor 1424.

Transistors included in the pixels of the pixel region 110, the scanning line driver circuit 102, or the signal line driver circuit 103 and transistors included in the serial-parallel conversion circuit 104 and the timing signal generation circuit 106 can be integrated and formed in the same step. Thus, the number of steps is reduced, so that the display device 100 with high image quality can be easily manufactured.

Alternatively, the transistors included in the pixels of the pixel region 110 may be formed in a step which is different from a step of forming the transistors included in the serial-parallel conversion circuit 104 and the timing signal generation circuit 106. For example, the transistors included in the pixels of the pixel region 110 can be transistors each having an amorphous semiconductor film, transistors each having a polycrystalline semiconductor film, or transistors each having an oxide semiconductor film.

As an amorphous semiconductor, hydrogenated amorphous silicon can be typically given. As a polycrystalline semiconductor, polysilicon (polycrystalline silicon) and the like can be typically given. Examples of polysilicon include so-called high-temperature polysilicon that contains polysilicon as a main component and is formed at a process temperature greater than or equal to 800° C., so-called low-temperature polysilicon that contains polysilicon as a main component and is formed at a process temperature less than or equal to 600° C., polysilicon obtained by crystallizing amorphous silicon by using an element that promotes crystallization or the like, and the like. It is needless to say that a microcrystalline semiconductor or a semiconductor which includes a crystal phase in part of a semiconductor layer can also be used.

Further, an oxide semiconductor may be used. As the oxide semiconductor, for example, any of the following can be used: indium oxide; tin oxide; zinc oxide; a two-component metal oxide such as an In—Zn-based oxide, a Sn—Zn-based oxide, an Al—Zn-based oxide, a Zn—Mg-based oxide, a Sn—Mg-based oxide, an In—Mg-based oxide, or an In—Ga-based oxide; a three-component metal oxide such as an In—Ga—Zn-based oxide, an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, or an In—Lu—Zn-based oxide; and a four-component metal oxide such as an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, or an In—Hf—Al—Zn-based oxide. Furthermore, any of the above oxide semiconductors may contain an element other than In, Ga, Sn, and Zn, for example, Si.

Here, for example, an In—Ga—Zn-based oxide semiconductor means an oxide semiconductor containing indium (In), gallium (Ga), and zinc (Zn), and there is no limitation on the composition ratio thereof.

The off-state current of a transistor having a channel formation region formed using an oxide semiconductor film can be very small. Therefore, a memory element can be formed using the transistor. Specifically, a transistor including an oxide semiconductor film is used as a selection transistor in each pixel of the pixel region 110, and a source electrode or a drain electrode of the transistor is connected to a gate electrode of a driving transistor for driving a display element. The off-state current of the selection transistor in each pixel is very small; therefore, an image signal that is input is stored as a potential of the gate electrode of the driving transistor. Accordingly, the pixel region 110 can have a memory function. Thus, for example, the pixel region 110 can store display data for one frame.

The display device 100 includes the counter substrate 1404 and the sealing material 1405. The light-emitting element in the pixel region 110 is sealed in a space 1407 enclosed by the element substrate 101, the counter substrate 1404, and the sealing material 1405 surrounding the pixel region 110.

On the counter substrate 1404 exemplified in this embodiment, the color filter 1434 is provided to overlap with the light-emitting element provided in the pixel of the pixel region 110. The light-emitting element provided in the pixel emits white light. A color filter that transmits red light is provided for a pixel for expressing red, a color filter that transmits green light is provided for a pixel for expressing green, and a color filter that transmits blue light is provided for a pixel for expressing blue. Thus, a display device capable of full-color display can be provided.

FIG. 2A is a block diagram illustrating the structure of circuits in the display device 100. In the figure, ESD represents a protection circuit, and BUF represents a buffer circuit. FIG. 2B illustrates one example of a buffer circuit. With the buffer circuit, a waveform whose rising edge is gradual can be shaped.

The first external connection terminal 105*a* is a terminal for input of a serial signal VIDEO_S including an image signal from the outside of the display device 100. The input serial signal VIDEO_S is supplied to the serial-parallel conversion circuit 104 through the first external connection terminal 105*a*.

The second external connection terminal 105*b* is a terminal for input of a clock signal CLK from the outside of the display device 100. The input clock signal CLK is supplied to the timing signal generation circuit 106 and the serial-parallel conversion circuit 104 through the second external connection terminal 105*b*.

The third external connection terminal 105*c* is a terminal for input of a start pulse signal SP from the outside of the display device 100. The input start pulse signal SP is supplied to the timing signal generation circuit 106 through the third external connection terminal 105*c*.

The fourth external connection terminal 105*d* is a terminal for input of a high power supply potential Vdd from the outside of the display device 100. The high power supply potential Vdd is supplied to each element that needs the high power supply potential Vdd, through the fourth external connection terminal 105*d*.

The fifth external connection terminal 105*e* is a terminal for input of a low power supply potential Vss from the outside of the display device 100. The low power supply potential Vss is supplied to each element that needs the low power supply potential Vss, through the fifth external connection terminal 105*e*.

The sixth external connection terminal 105*f* is a terminal for input of a ground potential GND from the outside of the display device 100. The ground potential GND is supplied to each element that needs the ground potential GND, through the sixth external connection terminal 105*f*.

The timing signal generation circuit 106 generates a serial-parallel conversion start pulse signal SPC_SP from the input clock signal CLK and the input start pulse signal SP to supply the serial-parallel conversion start pulse signal SPC_SP to the serial-parallel conversion circuit. Similarly, from the input clock signal CLK and the input start pulse signal SP, the timing signal generation circuit 106 generates a source clock signal S_CLK and a source start pulse signal S_SP to supply the source clock signal S_CLK and the source start pulse signal S_SP to the signal line driver circuit 103, and generates a gate clock signal G_CLK, a gate start pulse signal G_SP, and a pulse width control signal G_PWC to supply the gate clock signal G_CLK, the gate start pulse signal G_SP, and the pulse width control signal G_PWC to the scanning line driver circuit 102.

The serial-parallel conversion circuit 104 generates a parallel signal VIDEO including an image signal from the input serial signal VIDEO_S and serial-parallel conversion start pulse signal SPC_SP to supply the parallel signal VIDEO to the signal line driver circuit 103.

The display device 100 exemplified in this embodiment includes the first external connection terminal for supplying a serial signal to the serial-parallel conversion circuit, the second external connection terminal for supplying a clock signal to the timing signal generation circuit, the third external connection terminal for supplying a start pulse signal to the timing signal generation circuit, the fourth external connection terminal to which a high power supply potential is supplied, the fifth external connection terminal to which a low power supply potential is supplied, and the sixth external connection terminal to which a ground potential is supplied. As a result, a self-luminous display device with high image quality and fewer terminals can be provided.

Elements included in the display device 100 of one embodiment of the present invention will be described below. The display device 100 exemplified in this embodiment is an active-matrix display device; however, one embodiment of the present invention is not limited thereto and is applicable to a passive-matrix display device.

<Pixel Region>

The pixel region 110 includes V scanning lines each provided with H pixels. Each pixel includes three sub-pixels (specifically, a pixel R for expressing red, a pixel G for expressing green, and a pixel B for expressing blue) which are not shown.

The sub-pixels are provided at the intersections of the scanning lines and the signal lines. The sub-pixels are operated in accordance with a selection signal input from the scanning line and an image signal input from the signal line. Note that the sub-pixels exemplified in this embodiment each express n gray level.

The display device 100 exemplified in this embodiment displays an image in the pixel region at a frame rate fps.

<Scanning Line Driver Circuit>

The scanning line driver circuit 102 outputs a selection signal to each of the scanning lines provided in the pixel region 110.

<Signal Line Driver Circuit>

The signal line driver circuit 103 outputs an image signal to each of the signal lines provided in the pixel region 110.

<Serial-Parallel Conversion Circuit>

The serial-parallel conversion circuit 104, which includes a transistor having a crystalline silicon film formed over the element substrate 101, converts the input serial signal to a parallel signal and outputs the parallel signal to the signal line driver circuit 103.

The display device 100 exemplified in this embodiment is provided with the serial-parallel conversion circuit 104 including the transistor which has the channel formation region formed using the crystalline silicon film with high mobility and thus operates at high speed. Accordingly, even a serial signal input at high frequency can be converted to a parallel signal. As a result, the display device 100 with high image quality and fewer terminals can be provided.

Further, a transistor having a channel formation region formed using the crystalline silicon film formed over the element substrate 101 is used. Accordingly, a wiring and a space for bonding can be omitted; thus, a wiring can be further shortened.

Instead of the crystalline silicon film formed over the element substrate 101, any of a variety of single crystal semiconductors can be used. When a channel formation region of a transistor is formed using a single crystal semiconductor, the serial-parallel conversion circuit 104 can operate at high speed.

Typical examples of a single crystal semiconductor can include semiconductor substrates such as single crystal semiconductor substrates including elements that belong to Group 14, such as a single crystal silicon substrate, a single crystal germanium substrate, and a single crystal silicon germanium substrate; and compound semiconductor substrates (such as an SiC substrate, a sapphire substrate, and a GaN substrate). Preferred one is a silicon on insulator (SOI) substrate in which a single crystal semiconductor layer is provided on an insulating surface.

As a method for forming the SOI substrate, any of the following methods can be used: a method in which oxygen ions are implanted into a mirror-polished wafer and then heating is performed at a high temperature, whereby an oxide layer is formed at a certain depth from a surface of the wafer and a defect caused in the surface layer is eliminated; a method in which a semiconductor substrate is separated by utilizing the growth of microvoids, which are formed by hydrogen ion irradiation, by heat treatment; a method in which a single crystal semiconductor layer is formed on an insulating surface by crystal growth; and the like.

In this embodiment, ions are added through one surface of a single crystal semiconductor substrate, and an embrittlement layer is formed at a certain depth from the surface of the single crystal semiconductor substrate. Then, an insulating layer is formed over the surface of the single crystal semiconductor substrate or over the element substrate 101. Next, heat treatment is performed in the state in which the single crystal semiconductor substrate provided with the embrittlement layer and the element substrate 101 are bonded to each other with the insulating layer interposed therebetween, so that a crack is generated in the embrittlement layer to separate the single crystal semiconductor substrate along the embrittlement layer. Thus, a single crystal semiconductor layer, which is separated from the single crystal semiconductor substrate, is formed as a semiconductor layer over the element substrate 101. Note that a glass substrate can be used as the element substrate 101.

Regions electrically insulated from each other may be formed in the semiconductor substrate, and the transistor included in the serial-parallel conversion circuit may be formed using the regions electrically insulated from each other.

Transistors included in the pixel region 110, the scanning line driver circuit 102, the signal line driver circuit 103, and the timing signal generation circuit 106 and transistors included in the serial-parallel conversion circuit 104 can be integrated and formed in the same step. Thus, the number of steps is reduced, so that the display device 100 with high image quality can be easily manufactured.

The transistor having a channel formation region formed using a single crystal semiconductor is suitably used in a pixel of the pixel region 110 together with a light-emitting element. This is because variation in electric characteristics such as threshold voltage of the transistor, which is caused by bonding defects at grain boundaries, can be reduced. Accordingly, in the display device of one embodiment of the present invention, the light-emitting element can normally operate even if a circuit for compensating threshold voltage is not provided in each pixel. The number of circuit elements per pixel can therefore be reduced, increasing the flexibility in layout. Thus, a high-resolution light-emitting device can be achieved. For example, a display device having a matrix of a plurality of pixels, specifically 350 pixels or more per inch (i.e., the horizontal resolution is 350 pixels per inch (ppi) or more), more preferably 400 or more pixels per one inch (i.e., the horizontal resolution is 400 ppi or more) can be achieved.

Moreover, a transistor having a channel formation region formed using a single crystal semiconductor can be downsized while keeping high current drive capability. The use of the downsized transistor leads to a reduction in the area of a circuit portion that does not contribute to display operation, resulting in an increase in the area of a region of the display portion where an image is displayed and a reduction in the frame size of the light-emitting device.

The signal line driver circuit 103 is provided along a row of the pixel region 110, and the scanning line driver circuit 102 is provided along a column of the pixel region 110. The serial-parallel conversion circuit 104 is provided in a corner portion where the signal line driver circuit 103 and the scanning line driver circuit 102 are close to each other. The serial-parallel conversion circuit 104 is provided more apart from the pixel region 110 than the scanning line driver circuit 102 is. A wiring 104*a* is provided between the pixel region 110 and the signal line driver circuit 103 so as to extend along the row of the pixel region 110. Through the wiring 104*a*, a parallel signal is supplied from the serial-parallel conversion circuit 104 to the signal line driver circuit.

In the display device 100 exemplified in this embodiment, the serial-parallel conversion circuit 104 is provided close to the signal line driver circuit 103. Further, the wiring 104*a*, through which the parallel signal is supplied from the serial-parallel conversion circuit 104 to the signal line driver circuit 103, is provided along the row of the pixel region. Accordingly, a wiring for connecting the serial-parallel conversion circuit 104 to the signal line driver circuit 103 can be shortened as compared to other arrangement, whereby delay can be made less likely to occur. As a result, a display device with high image quality and fewer terminals can be provided.

<RC Load RC>

An RC load RC between the first external connection terminal 105*a* and the serial-parallel conversion circuit 104 in the display device 100 exemplified in this embodiment will be described.

It is necessary that settling time tset of the serial-parallel conversion circuit be shorter than allowable time tsamp for transmitting a signal to one sub-pixel.

In the case where the RC load RC is present between the first external connection terminal 105*a* and the serial-parallel conversion circuit 104, a signal input to the first external connection terminal 105*a* is input to the serial-parallel conversion circuit 104 with delay (see FIG. 3). When a signal with an amplitude Vin is input to the first external connection terminal 105*a*, a signal Vout which is input to the serial-parallel conversion circuit 104 with delay is changed depending on time t as expressed by a formula (2) below.

$$\frac{Vout}{Vin} = \left(1 - \exp\left(-\frac{t}{RC}\right)\right) \tag{2}$$

Here, as the signal with an amplitude Vin, an image signal with an amplitude corresponding to a maximum grayscale (nth grayscale) is input to the first external connection terminal 105*a*. In that case, settling time tset is defined as time in which Vout approaches Vin gradually and reaches a potential lower than Vin by ½ grayscale. Therefore, settling time tset can be expressed by a formula (3) below (see FIG. 3).

$$tset = -RC \cdot ln\left(1 - \frac{Vin \cdot ((2n-1)/2n)}{Vin}\right) = RC \cdot ln(2n) \tag{3}$$

Allowable time tsamp for transferring one analog signal to one sub-pixel is expressed by a formula (4) below.

$$tsamp = \frac{1}{3 \cdot H \cdot V \cdot fps} \tag{4}$$

It is necessary that settling time tset be shorter than allowable time tsamp for transfer to one sub-pixel. Therefore, in the display device 100 of one embodiment of the present invention, the RC load RC between the first external connection terminal 105*a* and the serial-parallel conversion circuit 104 satisfies the formula (1).

$$RC < \frac{1}{3 \cdot H \cdot V \cdot fps \cdot ln(2n)} \tag{1}$$

In the formula (1), H represents the number of pixels provided for one scanning line (also called the number of pixels in the horizontal direction), V represents the number of scanning lines (also called the number of pixels in the vertical direction), fps represents a frame rate, and n represents the number of grayscales.

<Timing Signal Generation Circuit>

The timing signal generation circuit 106 includes a transistor having a crystalline silicon film formed over the element substrate 101. The timing signal generation circuit 106 generates timing signals from the clock signal input to the second external connection terminal 105*b* and the start pulse signal input to the third external connection terminal 105*c* and outputs the timing signals to the scanning line driver circuit 102, the signal line driver circuit 103, and the serial-parallel conversion circuit 104.

The display device 100 exemplified in this embodiment is provided with the timing signal generation circuit 106 including the transistor which has the channel formation region formed using the crystalline silicon film with high mobility and thus operates at high speed. The timing signal generation circuit 106 can generate two or more timing signals from the clock signal supplied through the second external connection terminal 105*b*. Accordingly, the display device 100 can be driven using two or more timing signals without an external connection terminal for a timing signal. As a result, the display device 100 with high image quality and fewer terminals can be provided.

The transistors each having the crystalline silicon film formed over the element substrate 101 can be formed in the same step. Accordingly, transistors included in the pixel region 110, the scanning line driver circuit 102, the signal line driver circuit 103, the serial-parallel conversion circuit 104, and the timing signal generation circuit 106 can be integrated. Thus, the number of steps is reduced, so that the display device 100 with high image quality can be easily manufactured.

The timing signal generation circuit 106 is provided in a position close to the second external connection terminal 105*b*. Further, the timing signal generation circuit 106 is provided adjacent to the serial-parallel conversion circuit 104 and apart from the pixel region 110.

In the display device 100 exemplified in this embodiment, the timing signal generation circuit 106 is provided in a position close to the second external connection terminal 105*b* for supplying a clock signal. Further, the timing signal generation circuit 106 is provided adjacent to the serial-parallel conversion circuit 104 and apart from the pixel region 110. Accordingly, a wiring for connecting the timing signal generation circuit 106 to the second external connection terminal 105*b* can be shortened as compared to other arrangement, whereby delay can be made less likely to occur. As a result, a display device with high image quality and fewer terminals can be provided.

<Light-Emitting Element>

The light-emitting element 1418 is provided in the subpixel of the display device 100 exemplified in this embodiment. The light-emitting element 1418 which is applicable to the display device 100 exemplified in this embodiment includes the first electrode 1413, the second electrode 1417, and the layer 1416 containing a light-emitting organic compound between the first electrode 1413 and the second electrode 1417. One of the first electrode 1413 and the second electrode 1417 is an anode, and the other thereof is a cathode. When voltage higher than the threshold voltage of the light-emitting element 1418 is applied between the first electrode 1413 and the second electrode 1417, holes are injected from the anode and electrons are injected from the cathode to the layer 1416 containing a light-emitting organic compound. The injected holes and electrons are recombined, whereby the light-emitting organic compound emits light.

Here, a layer or a stacked body which includes one region where electrons and holes are recombined is referred to as a light-emitting unit. In the layer containing a light-emitting organic compound, at least one light-emitting unit can be included, and two or more light-emitting units may overlap with each other. For example, two light-emitting units are formed so that the color of light emitted from one of the two light-emitting units is complementary to the color of light emitted from the other of the two light-emitting units; thus, a light-emitting element that emits white light can be formed.

<Common Connection Portion>

The display device 100 of one embodiment of the present invention includes a plurality of pixels in the pixel region 110. Each of the pixels includes the light-emitting element 1418 including the first electrode 1413, the second electrode 1417, and the layer 1416 containing a light-emitting organic compound between the first electrode 1413 and the second electrode 1417.

The first electrode 1413, which is provided over the element substrate 101, is supplied with power through the transistor 1412. Note that the pixels in the pixel region have similar structures.

The second electrode 1417, which is extended to the outside of the pixel region 110, is supplied with power through the common connection portion 109*a* and the common connection portion 109*b*. Here, the common connection portion 109*a* and the common connection portion 109*b* are provided so as to surround the pixel region. Accordingly, voltage drop due to sheet resistance of the second electrode can be suppressed in the entire pixel region, whereby display unevenness can be reduced. As a result, a self-luminous display device with high image quality and fewer terminals can be provided. Note that the common connection portion 109*a* and the common connection portion 109*b* are electrically connected to each other through a conductive layer which overlaps with the common connection portion 109*a* and the common connection portion 109*b* but is not shown.

Particularly, in the case where the common connection portion 109*a* having a larger width than the serial-parallel conversion circuit is provided on the serial-parallel conversion circuit side of the pixel region, the area of contact between the common connection portion 109*a* and the second electrode 1417 is large. Thus, connection can be ensured. Further, the use of the common connection portion 109*a* having a large width enables wiring resistance to be reduced.

This embodiment can be combined with any of the other embodiments in this specification as appropriate.

Embodiment 2

In this embodiment, examples of an electronic device to which a display device of one embodiment of the present invention is applied will be described with reference to FIGS. 4A to 4C.

Examples of the electronic device to which the display device is applied include television sets (also referred to as televisions or television receivers), monitors of computers or the like, digital cameras, digital video cameras, digital photo frames, mobile phones (also referred to as cell phones or cellular phones), portable game consoles, personal digital assistants, audio reproducing devices, and large-sized game machines such as pachinko machines.

Figure 4A:
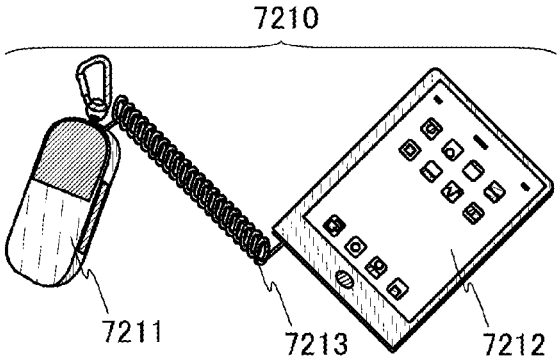
FIGS. 4A to 4C each illustrate an electronic device according to an embodiment.

FIG. 4A illustrates an example of a personal digital assistant. In a personal digital assistant 7210, a main body 7211 and a display device 7212 are connected to each other by a cable 7213. The cable 7213 transmits serial data including image data from the main body 7211 to the display device 7212 and transmits operation performed on the display device 7212 to the main body 7211. Further, the cable 7213 also has a function of preventing the display device from being damaged by being dropped.

Figure 4B:
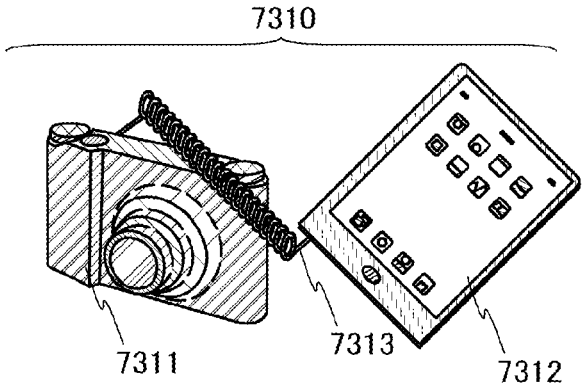

FIG. 4B illustrates an example of a digital camera. In a digital camera 7310, a main body 7311 and a display device 7312 are connected to each other by a cable 7313. The cable 7313 transmits serial data including image data from the main body 7311 to the display device 7312 and transmits operation performed on the display device 7312 to the main body 7311.

Figure 4C:
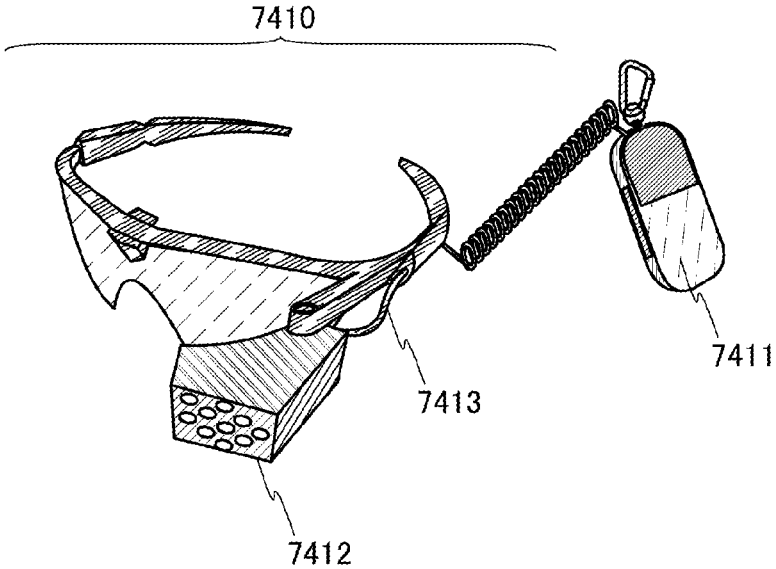

FIG. 4C illustrates an example of a head-mounted display. In a head-mounted display 7410, a main body 7411 and a display device 7412 are connected to each other by a cable 7413. The cable 7413 transmits serial data including image data from the main body 7411 to the display device 7412 set in a housing. Further, the movement of eyeball and eyelid of a user can be captured by a camera in the housing, and data on the movement can be transmitted to the main body 7411. From the data on the movement of the eyeball and the eyelid, coordinates of the points the user looks at are calculated in the main body 7411. Thus, the user can use the points for a pointing device.

In the display device of one embodiment of the present invention, the number of terminals is reduced, which leads to reduction in the number of wirings in a cable to be connected to an external device. In addition, the cable is bent with flexibility and the weight thereof is reduced. As a result, display can be seen with only a lightweight display portion held in a hand, for example, while a main body is put in a pocket or a bag. Further, the main body can be operated with the use of the display portion.

This embodiment can be combined with any of the other embodiments in this specification as appropriate.

This application is based on Japanese Patent Application serial no. 2011-282439 filed with Japan Patent Office on Dec. 23, 2011, the entire contents of which are hereby incorporated by reference.

What is claimed is:

1. A display device comprising:

a pixel region over a substrate, the pixel region including a plurality of pixels arranged in a matrix;

a scanning line driver circuit connected to the pixel region;

a signal line driver circuit connected to the pixel region;

a serial-parallel conversion circuit configured to supply a parallel signal to the signal line driver circuit; and a first external connection terminal configured to supply a serial signal to the serial-parallel conversion circuit, wherein the serial-parallel conversion circuit comprises a transistor over the substrate, and wherein RC of a load between the first external connection terminal and the serial-parallel conversion circuit satisfies a formula (1):

$$RC < \frac{1}{3 \cdot H \cdot V \cdot fps \cdot ln(2n)} \quad (1)$$

wherein:

H represents the number of pixels provided for one scanning line;

V represents the number of scanning lines;

fps represents a frame rate; and n represents the number of grayscales.

2. A display device comprising:

a pixel region over a substrate, the pixel region including a plurality of pixels arranged in a matrix;

a scanning line driver circuit connected to the pixel region;

a signal line driver circuit connected to the pixel region;

a serial-parallel conversion circuit configured to supply a parallel signal to the signal line driver circuit; and a first external connection terminal configured to supply a serial signal to the serial-parallel conversion circuit, wherein the serial-parallel conversion circuit comprises a transistor having an oxide semiconductor film over the substrate, and wherein RC of a load between the first external connection terminal and the serial-parallel conversion circuit satisfies a formula (1):

$$RC < \frac{1}{3 \cdot H \cdot V \cdot fps \cdot ln(2n)} \quad (1)$$

wherein:

H represents the number of pixels provided for one scanning line;

V represents the number of scanning lines;

fps represents a frame rate; and n represents the number of grayscales.

3. A module comprising:

a display device comprising:

a pixel region over a substrate, the pixel region including a plurality of pixels arranged in a matrix;

a scanning line driver circuit connected to the pixel region;

a signal line driver circuit connected to the pixel region;

a serial-parallel conversion circuit configured to supply a parallel signal to the signal line driver circuit; and a first external connection terminal configured to supply a serial signal to the serial-parallel conversion circuit; and;

an FPC electrically connected to the first external connection terminal, wherein the serial-parallel conversion circuit comprises a transistor over the substrate, and wherein RC of a load between the first external connection terminal and the serial-parallel conversion circuit satisfies a formula (1):

$$RC < \frac{1}{3 \cdot H \cdot V \cdot fps \cdot ln(2n)} \quad (1)$$

wherein:

H represents the number of pixels provided for one scanning line;

V represents the number of scanning lines;

fps represents a frame rate; and n represents the number of grayscales.

4. The display device according to claim 1, wherein the transistor has a crystalline silicon film.

5. The display device according to claim 1, wherein the signal line driver circuit is provided along a row of the pixel region, wherein the scanning line driver circuit is provided along a column of the pixel region, wherein the serial-parallel conversion circuit is provided in a corner portion where the signal line driver circuit and the scanning line driver circuit are close to each other, wherein the serial-parallel conversion circuit is provided more apart from the pixel region than the scanning line driver circuit is, wherein a wiring is provided between the pixel region and the signal line driver circuit so as to extend along the row of the pixel region, and wherein the wiring is configured to supply the parallel signal from the serial-parallel conversion circuit to the signal line driver circuit.

6. The display device according to claim 2, wherein the signal line driver circuit is provided along a row of the pixel region, wherein the scanning line driver circuit is provided along a column of the pixel region, wherein the serial-parallel conversion circuit is provided in a corner portion where the signal line driver circuit and the scanning line driver circuit are close to each other, wherein the serial-parallel conversion circuit is provided more apart from the pixel region than the scanning line driver circuit is, wherein a wiring is provided between the pixel region and the signal line driver circuit so as to extend along the row of the pixel region, and wherein the wiring is configured to supply the parallel signal from the serial-parallel conversion circuit to the signal line driver circuit.

7. The module according to claim 3, wherein the signal line driver circuit is provided along a row of the pixel region, wherein the scanning line driver circuit is provided along a column of the pixel region, wherein the serial-parallel conversion circuit is provided in a corner portion where the signal line driver circuit and the scanning line driver circuit are close to each other, wherein the serial-parallel conversion circuit is provided more apart from the pixel region than the scanning line driver circuit is, wherein a wiring is provided between the pixel region and the signal line driver circuit so as to extend along the row of the pixel region, and wherein the wiring is configured to supply the parallel signal from the serial-parallel conversion circuit to the signal line driver circuit.

8. The display device according to claim 1, further comprising:

a timing signal generation circuit;

a second external connection terminal configured to supply a clock signal to the timing signal generation circuit; and a third external connection terminal configured to supply a start pulse signal to the timing signal generation circuit, wherein the timing signal generation circuit comprises a transistor over the substrate, and wherein the timing signal generation circuit outputs timing signals to the signal line driver circuit, the scanning line driver circuit, and the serial-parallel conversion circuit.

9. The display device according to claim 2, further comprising:

a timing signal generation circuit;

a second external connection terminal configured to supply a clock signal to the timing signal generation circuit; and a third external connection terminal configured to supply a start pulse signal to the timing signal generation circuit, wherein the timing signal generation circuit comprises a transistor over the substrate, and wherein the timing signal generation circuit outputs timing signals to the signal line driver circuit, the scanning line driver circuit, and the serial-parallel conversion circuit.

10. The module according to claim 3, further comprising:

a timing signal generation circuit;

a second external connection terminal configured to supply a clock signal to the timing signal generation circuit; and a third external connection terminal configured to supply a start pulse signal to the timing signal generation circuit, wherein the timing signal generation circuit comprises a transistor over the substrate, and wherein the timing signal generation circuit outputs timing signals to the signal line driver circuit, the scanning line driver circuit, and the serial-parallel conversion circuit.

11. The display device according to claim 1, further comprising:

a timing signal generation circuit;

a second external connection terminal configured to supply a clock signal to the timing signal generation circuit; and a third external connection terminal configured to supply a start pulse signal to the timing signal generation circuit, wherein the timing signal generation circuit is provided in a position close to the second external connection terminal, and wherein the timing signal generation circuit is provided adjacent to the serial-parallel conversion circuit and apart from the pixel region.

12. The display device according to claim 2, further comprising:

a timing signal generation circuit;

a second external connection terminal configured to supply a clock signal to the timing signal generation circuit; and a third external connection terminal configured to supply a start pulse signal to the timing signal generation circuit, wherein the timing signal generation circuit is provided in a position close to the second external connection terminal, and wherein the timing signal generation circuit is provided adjacent to the serial-parallel conversion circuit and apart from the pixel region.

13. The module according to claim 3, further comprising:

a timing signal generation circuit;

a second external connection terminal configured to supply a clock signal to the timing signal generation circuit; and a third external connection terminal configured to supply a start pulse signal to the timing signal generation circuit, wherein the timing signal generation circuit is provided in a position close to the second external connection terminal, and wherein the timing signal generation circuit is provided adjacent to the serial-parallel conversion circuit and apart from the pixel region.

14. The display device according to claim 1, further comprising:

a fourth external connection terminal to which a high power supply potential is supplied;

a fifth external connection terminal to which a low power supply potential is supplied; and a sixth external connection terminal to which a ground potential is supplied, wherein the pixels provided in the pixel region each include a light-emitting element, wherein the light-emitting element comprises a first electrode over the substrate, a layer containing a light-emitting organic compound over the first electrode, and a second electrode over the layer containing a light-emitting organic compound, wherein the first electrode is supplied with a potential between the high power supply potential and the low power supply potential in accordance with the serial signal, and wherein the second electrode is supplied with one of the high power supply potential and the low power supply potential.

15. The display device according to claim 2, further comprising:

a fourth external connection terminal to which a high power supply potential is supplied;

a fifth external connection terminal to which a low power supply potential is supplied; and a sixth external connection terminal to which a ground potential is supplied, wherein the pixels provided in the pixel region each include a light-emitting element, wherein the light-emitting element comprises a first electrode over the substrate, a layer containing a light-emitting organic compound over the first electrode, and a second electrode over the layer containing a light-emitting organic compound, wherein the first electrode is supplied with a potential between the high power supply potential and the low power supply potential in accordance with the serial signal, and wherein the second electrode is supplied with one of the high power supply potential and the low power supply potential.

16. The module according to claim 3, further comprising:

a fourth external connection terminal to which a high power supply potential is supplied;

a fifth external connection terminal to which a low power supply potential is supplied; and a sixth external connection terminal to which a ground potential is supplied, wherein the pixels provided in the pixel region each include a light-emitting element, wherein the light-emitting element comprises a first electrode over the substrate, a layer containing a light-emitting organic compound over the first electrode, and a second electrode over the layer containing a light-emitting organic compound, wherein the first electrode is supplied with a potential between the high power supply potential and the low power supply potential in accordance with the serial signal, and wherein the second electrode is supplied with one of the high power supply potential and the low power supply potential.

17. The display device according to claim 1, wherein the display device is a light emitting device.

18. The display device according to claim 2, wherein the display device is a light emitting device.

19. The module according to claim 3, wherein the display device is a light emitting device.

* * * * *